US008760237B2

(12) United States Patent
Ryu et al.

(10) Patent No.: US 8,760,237 B2
(45) Date of Patent: Jun. 24, 2014

(54) HIGH-VOLTAGE WIDEBAND PULSE LOAD

(75) Inventors: Seung-Kab Ryu, Daejeon (KR); Kyung-Hoon Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 308 days.

(21) Appl. No.: 13/326,466

(22) Filed: Dec. 15, 2011

(65) Prior Publication Data

US 2012/0299669 A1 Nov. 29, 2012

(30) Foreign Application Priority Data

May 23, 2011 (KR) ..... 10-2011-0048715

(51) Int. Cl.
*H01P 1/26* (2006.01)

(52) U.S. Cl.
CPC ..... *H01P 1/26* (2013.01)
USPC ..... 333/22 R

(58) Field of Classification Search
USPC ..... 333/22 R, 34, 81 A; 439/620
See application file for complete search history.

(56) References Cited

U.S. PATENT DOCUMENTS 3,174,123 A * 3/1965 Frederico ..... 333/81 A
3,324,424 A * 6/1967 Barker ..... 333/22 R
6,019,622 A 2/2000 Takahashi et al.
6,501,349 B2 * 12/2002 Jokilehto et al. ..... 333/222
2009/0111315 A1 4/2009 Kato et al.

FOREIGN PATENT DOCUMENTS

| | | | |
|---|---|---|---|
| EP | 0 023 437 | A1 | 2/1981 |
| JP | 1993-225845 | A | 9/1993 |
| JP | 1998-247562 | A | 9/1998 |
| JP | 2004-523857 | A | 8/2004 |
| JP | 2009-110707 | A | 5/2009 |
| WO | 02/41460 | A1 | 5/2002 |

OTHER PUBLICATIONS

J E Dolan et al., "A 50Ω, 50KV Ceramic Disc Coaxial Load," IEEE Pulsed Power Conference, 2005, pp. 1443-1448, Cardiff, UK.

* cited by examiner

*Primary Examiner* — Stephen Jones
(74) *Attorney, Agent, or Firm* — LRK Patent Law Firm

(57) ABSTRACT

A high-voltage wideband pulse load is provided. The high-voltage wideband pulse load includes an internal line, a dielectric substance, and an external housing. The internal line includes input terminal, connection electrode and a rod resistor. The resistance of the internal line linearly increases along the moving direction of an incoming pulse by the rod resistor. The dielectric substance is coupled to the internal line in a coaxial structure which covers the exterior of the internal line, and is configured to have a shape of a non-linearly decreasing external diameter along the moving direction so that impedance linearly decreases along the moving direction in contrast with the resistance of the internal line. The external housing is coupled to the dielectric substance in a coaxial structure which covers the exterior of the dielectric substance, and is formed of metal.

8 Claims, 5 Drawing Sheets

HIGH-VOLTAGE WIDEBAND PULSE LOAD

CROSS REFERENCE TO RELATED APPLICATION

This application claims the benefit of Korean Patent Application No. 10-2011-0048715, filed on May 23, 2011, which is hereby incorporated by reference in its entirety into this application.

BACKGROUND OF THE INVENTION

1. Technical Field

The present invention relates generally to a high-voltage wideband pulse load, and, more particularly, to a high-voltage wideband pulse termination load which has the wideband frequency performance of a high-voltage pulse.

2. Description of the Related Art

FIG. 1 is a view illustrating a prior art high-voltage load.

As shown in FIG. 1, a high-voltage load 10 includes a plurality of ceramic resistive elements 11 which are arranged in a stacked structure on a coaxial line, and includes a cable termination device 12 which terminates input impedance to 50 ohm.

The high-voltage load 10 includes an HN connector 13 which functions as an input terminal, and includes a dielectric substance 14 which is composed of oil in order to have insulation resistance.

Such a ceramic resistive element 11 is physically 1 inch long. The oil is not treated inside the ceramic resistive element, and a space between an internal electrode, which forms a high-voltage potential, and an earth line is filled with air.

However, since the internal diameter and external diameter of the high-voltage load 10 are designed to correspond to specific impedance, the external diameter of the HN connector 13 is not large enough to have high-voltage insulation resistance because of the restricted internal diameter. Therefore, when a pulse of dozens of kV is received, a dielectric breakdown phenomenon may occur in the HN connector 13. Further, since the gaps of the ceramic resistive elements 11 which are connected in parallel are filled with air, a dielectric breakdown may occur because of the corona phenomenon which is generated at high voltage.

As described above, there is a problem because it is difficult to use the prior art high-voltage load 10 as a high-voltage pulse load.

FIG. 2 is a view illustrating a prior art coaxial cable load.

As shown in FIG. 2, the coaxial cable load 20 is configured in such a way that the radius of the external housing 22 which covers a central electrode 21 gradually decreases such that the impedance of a coaxial line gradually decreases in a longitudinal direction, and that a resistive material 24 is deposited on the surface of a dielectric substance 23 in order to form a sheet resistor.

In the coaxial cable load 20, heat energy which is absorbed into the sheet resistor is easily transmitted to the external housing 22 which has a good thermal radiation metal structure, so that the heat energy may be air-cooled and annihilated.

The key idea of the coaxial cable load 20 in the aspect of structural characteristic is that of deposited sheet resistance on the surface between dielectrics and external housing, but has the problem in that it is difficult to deposit the sheet resistor regularly having wanted specific impedance, thereby being difficult to implement target impedance accurately.

As described above, in order to implement a termination load of an operational frequency domain of several GHz or higher and a high-voltage pulse of dozens of kV, both wideband frequency performance and high insulation voltage performance should be satisfied at the same time. However, since the characteristics of the two performances conflict with each other, it is difficult to solve the problem using the prior art technology.

SUMMARY OF THE INVENTION

Accordingly, the present invention has been made keeping in mind the above problems occurring in the prior art, and an object of the present invention is to provide a high-voltage wideband pulse load which has wideband frequency performance and high-voltage insulation resistance performance at the same time in order to test a high-voltage fast transient pulse.

In order to accomplish the above object, the present invention provides a high-voltage wideband pulse load, including an internal line provided with a rod resistor which has resistance corresponding to predetermined characteristic impedance, and configured such that the resistance of the internal line is made to linearly increase along the moving direction of an incoming pulse by the rod resistor; a dielectric substance coupled to the internal line in a coaxial structure which covers the exterior of the internal line, and configured to have a shape of a non-linearly decreasing external diameter along the moving direction so that impedance linearly decreases along the moving direction in contrast with the resistance of the internal line; and an external housing coupled to the dielectric substance in a coaxial structure which covers the exterior of the dielectric substance, and formed of metal.

Here, total impedance, which is determined using the resistance of the internal line and the coaxial impedance of the dielectric substance, may correspond to the characteristic impedance.

Further, the dielectric substance may have a shape in which the external diameter thereof non-linearly decreases based on an exponential function in which an exponent is determined using the coaxial impedance.

Further, the external diameter of the dielectric substance may be proportional to a diameter of the internal line.

Further, the dielectric substance may include slits, which allow the length of the surface of the dielectric substance to be extended, around an input terminal.

Further, the input terminal may be connected to the rod resistor using a connection connector, and may be configured to transmit the pulse which flows through an external terminal to the rod resistor using the connection connector.

Further, the diameter of the connection connector is equal to the diameter of the rod resistor in order to prevent a pulse transmitted to the rod resistor from being dispersed or reflected.

Further, the internal line may further include the input terminal and the connection connector, and the total impedance may correspond to the coaxial impedance in a section from the input terminal to the connection connector.

Further, the input terminal may be coupled to the external terminal using one or more slits.

Further, the internal line may be connected to a ground using a blot which penetrates through a metal plate connected to the rod resistor.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
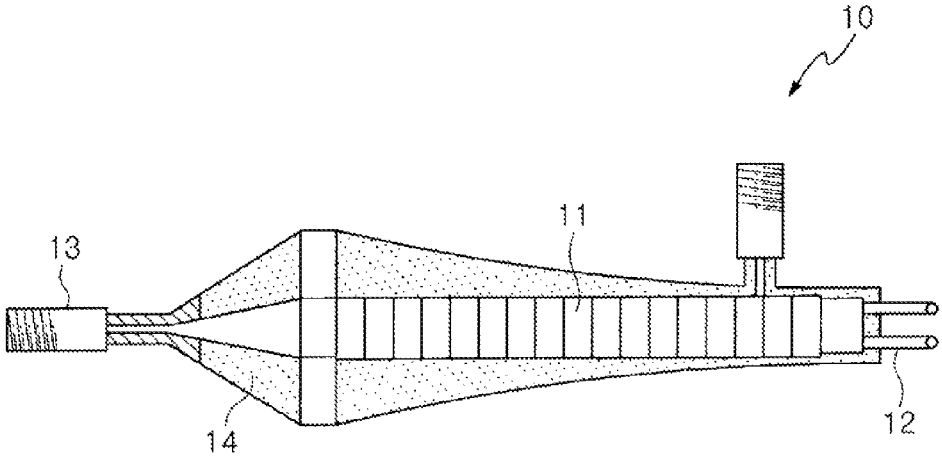
FIG. 1 (Prior Art)
FIG. 1 is a view illustrating a prior art high-voltage load.
Figure 2:
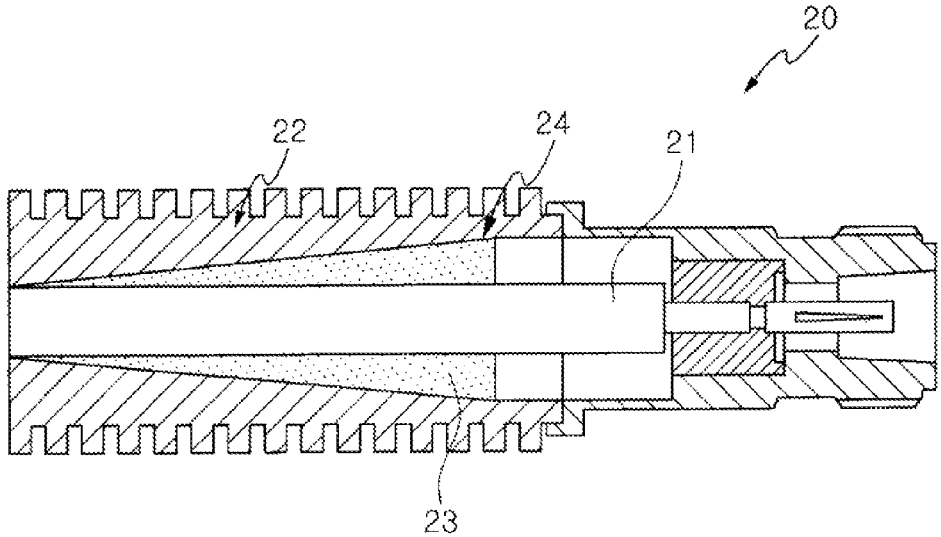
FIG. 2 (Prior Art)
FIG. 2 is a view illustrating a prior art coaxial cable load.

The present invention will be described in detail with reference to the accompanying drawings below. Here, in cases where the description would be repetitive and detailed descriptions of well-known functions or configurations would unnecessarily obscure the gist of the present invention, the detailed descriptions will be omitted. The embodiments of the present invention are provided to complete the explanation of the present invention to those skilled in the art. Therefore, the shapes and sizes of components in the drawings may be exaggerated to provide a more exact description.

A high-voltage wideband pulse load according to embodiments of the present invention will be described with reference to the accompanying drawings below.

First, a high-voltage wideband pulse load according to an embodiment of the present invention will be described with reference to FIGS. 3 and 4.

Figure 3:
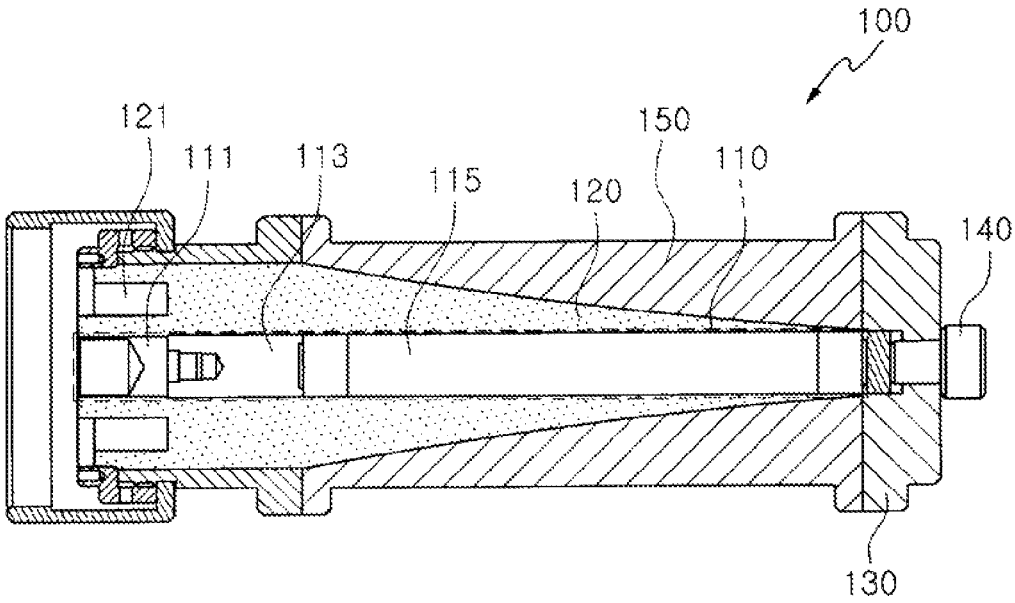
FIG. 3 is a longitudinal section view illustrating a high-voltage wideband pulse load according to an embodiment of the present invention.
Figure 4:
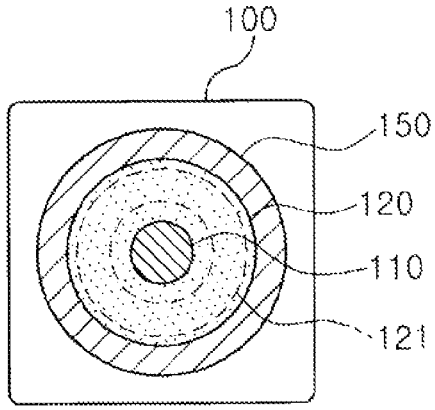
FIG. 4 is a cross sectional view illustrating a high-voltage wideband pulse load according to an embodiment of the present invention.

FIG. 3 is a longitudinal section view illustrating a high-voltage wideband pulse load according to an embodiment of the present invention, and FIG. 4 is a cross sectional view illustrating the high-voltage wideband pulse load according to an embodiment of the present invention.

As shown in FIGS. 3 and 4, a load 100 according to the embodiment of the present invention is used to terminate a high-voltage pulse, which has a peak voltage of dozens of kV, a rising time of several ns or less, a pulse width of several ns or less and a pulse repetition frequency of several kHz or less, into 50 ohm or a predetermined characteristic impedance. The load 100 includes an internal line 110, a dielectric substance 120, a metal plate 130, a bolt 140, and an external housing 150.

A high-voltage pulse propagates through the internal line 110 in the longitudinal direction, and the internal line 110 is formed by sequentially connecting an input terminal 111, a connection connector 113 and a solid resistor 115.

The input terminal 111 includes engagement slits which are formed at one end and are used to connect an external terminal, and includes a mechanical element which is formed at a remaining end and is used to connect the connection connector 113. Here, the input terminal 111 may include the mechanical element in the form of a bolt on which external threads are formed at the remaining end.

The connection connector 113 includes a mechanical element 111 which is formed at one end and is used to connect the input terminal, and the remaining end of the connection connector 113 is electrically connected to the solid resistor 115. Here, the remaining end of the connection connector 113 has the same diameter as the solid resistor 115. Further, the connection connector 113 may include a mechanical element in the form of a bolt on which external threads are formed at the one end.

Here, when the diameter of the connection connector 113 is different from that of the solid resistor 115 in the connection region thereof, it is difficult to obtain wideband frequency performance because an impedance mismatching is happened when a pulse is transmitted from the connection connector 113 to the solid resistor 115, and a flinging pulse and a reflecting pulse are generated at the impedance mismatched area. Therefore, the diameter of the connection connector 113 should be the same as that of the solid resistor 115.

The solid resistor 115 has the shape of a rod. The one end of the solid resistor 115 is coated with a conductive material in order to form an electrical connection with the connection connector 113, and the remaining end of the solid resistor 115 is connected to the bolt 140, which penetrates through the metal plate 130, in order to connect to the ground. Here, when the bolt 140 is screwed, the solid resistor 115 is squeezed in the direction of the connection connector 113, so that the solid resistor 115 may be electrically connected to the connection connector 113. Here, the solid resistor 115 corresponds to a carbon rod resistor, and has a length which is longer than the wavelength of an incoming pulse. Preferably, the solid resistor 115 may have a length of 5 cm or longer.

The solid resistor 115 may be analyzed as a distributed element rather than a lumped element because the physical length of the solid resistor 115 is longer than the length of an incoming pulse, may have the same sheet resistance for all the surface area, and may have resistance which linearly increases when a pulse comes in and propagates in the longitudinal direction.

The dielectric substance 120 has the dielectric permittivity determined based on the material thereof, and is coupled to the internal line 110 while covering the internal line 110 in a coaxial structure. Here, the dielectric substance 120 includes carved slits 121 formed in a ring shape around the input terminal 111, so that the length of the surface of the dielectric substance, which is necessary to provide insulation, is increased, thereby improving the insulation resistance performance for a high-voltage pulse having a peak voltage of dozens of kV or greater.

The external housing 150 corresponds to a ground electrode formed of metal, and is coupled to the dielectric substance 120 while covering the dielectric substance 120 in a coaxial structure.

Here, the diameter D of the dielectric substance 120 which covers the solid resistor 115 is determined as Equation 1 such that the dielectric substance 120 has characteristic impedance which is predetermined for all the spots of the load 100 by complementing the feature of the impedance distribution of the solid resistor 115.

$$Z = \sqrt{\frac{L}{C}} = \frac{1}{2\pi}\sqrt{\frac{\mu_0\mu_r}{\varepsilon_0\varepsilon_r}}\ln(D/d) = \frac{138}{\sqrt{\varepsilon_r}}\log_{10}\left(\frac{D}{d}\right) \quad (1)$$

where, "Z" indicates the coaxial impedance of a line, "μ0" indicates permeability in a vacuum, "μr" indicates the relative permeability of the dielectric substance 120, "∈0" indicates dielectric permittivity in a vacuum, "∈r" indicates relative permittivity of the dielectric substance 120, "D" indicates the diameter of the dielectric substance 120, and "d" indicates the diameter of the internal line 110.

The diameter D of the dielectric substance 120 may be expressed as Equation 2 using Equation 1.

$$D = d \cdot 10^{\frac{Z\sqrt{\varepsilon_r}}{138}} \tag{2}$$

Based on Equation 2, when the coaxial impedance of the dielectric substance 120 linearly decreases, the diameter D of the dielectric substance 120 which covers the solid resistor 115 may be determined based on an exponential function in which an exponent relates to the coaxial impedance of the dielectric substance 120 and the dielectric permittivity of the dielectric substance 120. Here, the diameter D of the dielectric substance 120 which covers the solid resistor 115 is proportional to the diameter of the internal line 110.

Therefore, when the coaxial impedance of the dielectric substance 120 linearly decreases, the diameter D of the dielectric substance 120 which covers the solid resistor 115 decreases based on the exponential function, so that the dielectric substance 120 which covers the solid resistor 115 has a shape in which the diameter thereof non-linearly decreases.

In Equation 1, "C" indicates equivalent capacitance formed on the differential area between the input terminal 111 and the ground when the input terminal 111 is separated from the ground using a medium, having a specific dielectric permittivity, as a boundary. "C" is determined using the following Equation 3:

$$C = \frac{2\pi\varepsilon_0\varepsilon_r}{\ln\left(\frac{D}{d}\right)} \tag{3}$$

In Equation 1, "L" indicates the equivalent inductance of the differential length in the coaxial cable structure which includes the internal line 110 and the dielectric substance 120. "L" is determined based on Equation 4.

$$L = \frac{\mu_0\mu_r}{2\pi}\ln(D/d) \tag{4}$$

Next, the impedance characteristics of the coaxial structure of the load according to an embodiment of the present invention will be described with reference to FIG. 5.

Figure 5:
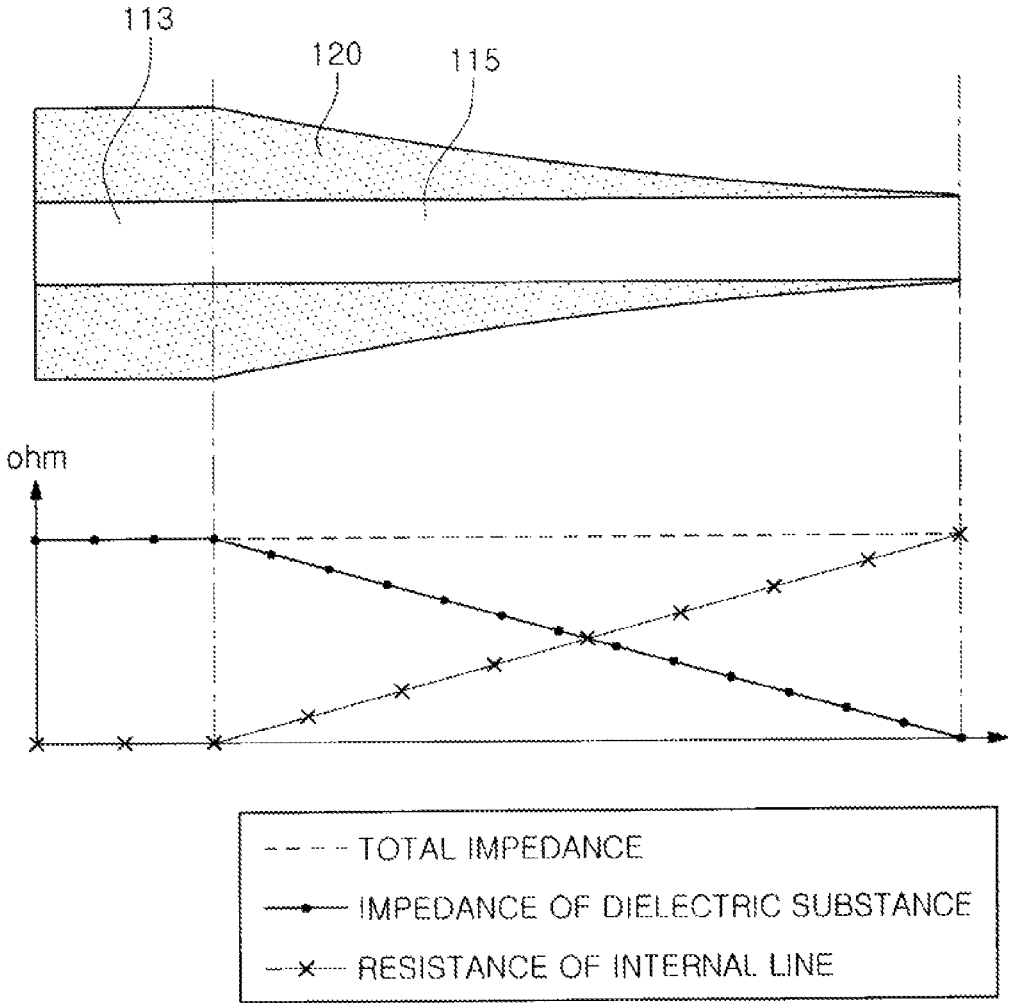
FIG. 5 is a view illustrating the impedance characteristics of the load according to the embodiment of the present invention.

FIG. 5 is a view illustrating the impedance characteristics of the load according to the embodiment of the present invention.

As shown in FIG. 5, the resistance of the internal line 110 is 0 ohm in a section where the connection connector 113 is connected to the internal line 110, linearly increases in a section where the solid resistor 115 is connected to the internal line 110, and becomes 50 ohm, corresponding to the characteristic impedance of the load 100, at the end of the internal line 110.

Meanwhile, the impedance of the dielectric substance 120 is 50 ohm in a section where the dielectric substance 120 covers the connection connector 113, linearly decreases in a section where the dielectric substance 120 covers the solid resistor 115, and becomes 0 ohm at the end of the dielectric substance 120.

Here, the total impedance of the load 100 is determined based on the resistance of the internal line 100 and the impedance of the dielectric substance 120. Therefore, the impedance of the load 100 is predetermined characteristic impedance for all domains.

Next, the structure of the connection scheme of input terminal according to an embodiment of the present invention will be described with reference to FIG. 6.

Figure 6:
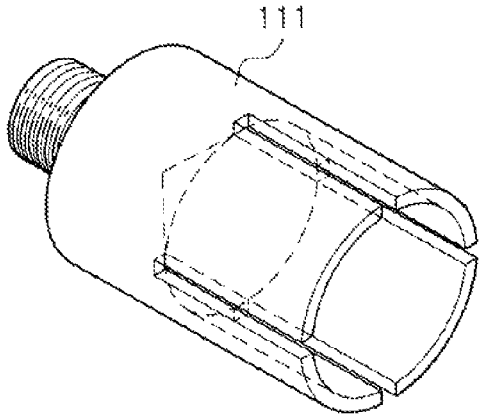
FIG. 6 is a view illustrating the structure of the connection scheme of input terminal according to an embodiment of the present invention.

FIG. 6 is a view illustrating the structure of the connection scheme of input terminal according to an embodiment of the present invention.

As shown in FIG. 6, the input terminal 111 includes engagement slits which are formed at one end and are used to combine with an external terminal, and includes a mechanical element which is formed at a remaining end and is formed in a bolt shape on which external threads are formed.

Here, the input terminal 111 may include slits, which form end portions of a cross when viewed from cross section, in order to improve the force of the connection with the external terminal. Therefore, the input terminal 111 is formed of a material having elastic force, and is easily coupled to the external terminal using the slits which are formed at the end portions of the cross.

Next, the impedance characteristics of a load according to an embodiment of the present invention will be described with reference to FIGS. 7 and 8.

Figure 7:
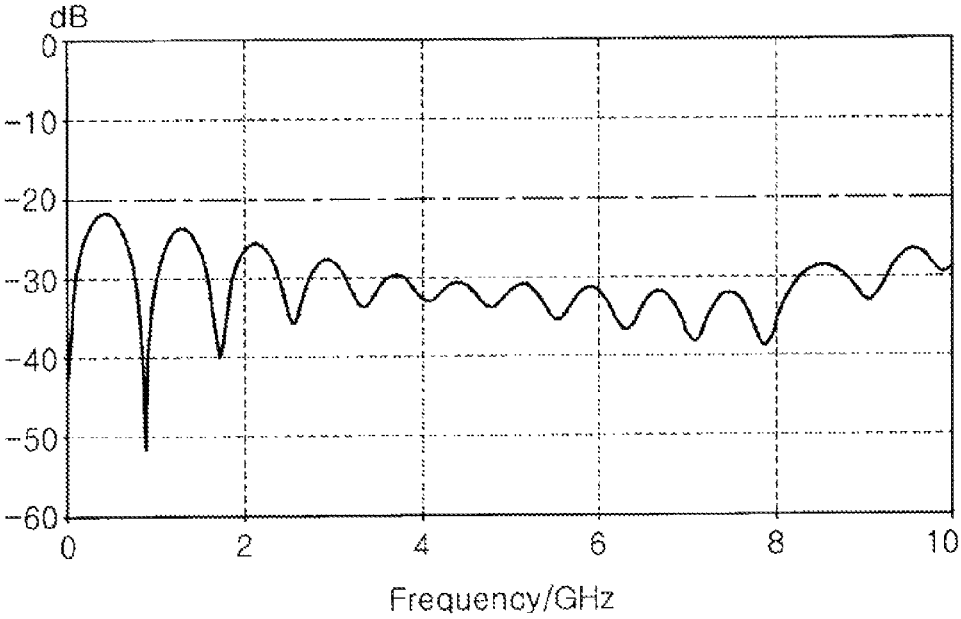
FIG. 7 is a view illustrating the impedance characteristics of the frequency domain of the load according to an embodiment of the present invention.

FIG. 7 is a view illustrating the impedance characteristics of the frequency domain of the load according to an embodiment of the present invention.

The impedance characteristics of the load 100 may be expressed using a ratio of an input pulse to a reflecting pulse in a frequency domain by measuring a small signal scattering para meter.

As shown in FIG. 7, the impedance characteristics of the frequency domain of the load 100 is a return loss of −20 dB or less in a wide frequency bandwidth of 10 GHz or greater.

Figure 8:
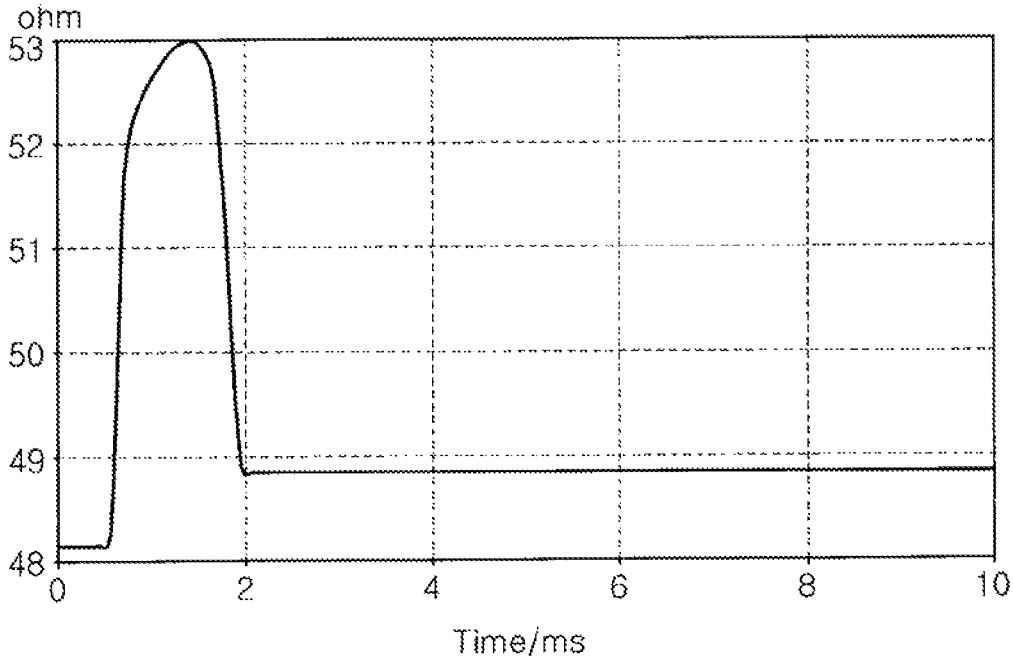
FIG. 8 is a view illustrating the impedance characteristics of the time domain of the load according to an embodiment of the present invention.

FIG. 8 is a view illustrating the impedance characteristics of the time domain of the load according to an embodiment of the present invention.

The characteristic of the impedance of the time domain of the load 100 may be expressed using impedance in the time domain using a Time Domain Reflectometer (TDR).

As shown in FIG. 8, when the load 100 is manufactured to have an impedance of 50 ohm, it can be seen that the impedance characteristics of the time domain of the load 100 has the performance which falls within a change rate of 5% based on 50 Ohm.

As described above, the load 100 has the impedance characteristics, which are matched to 50 ohm in a frequency bandwidth of 0 to 10 GHz.

According to the embodiment of the present invention, the physical length of a rod resistor is far longer than the wavelength of an input pulse, so that resistance linearly increases in the longitudinal direction of the rod resistor. Therefore, the present invention has the advantage of complementing the characteristics of the rod resistor in which the coaxial characteristic impedance linearly increases in the longitudinal direction by gradually decreasing a ratio of an internal diameter to an external diameter, the ratio being fixed in a coaxial structure. Therefore, there is the advantage in that desired characteristic impedance may be maintained in all the areas of a load in a coaxial structure.

Further, when the high-voltage pulse load according to the embodiment of the present invention is used, there is the advantage in that the waveform of a high-voltage pulse can be tested using a capacitive pulse divider or a probe apparatus instead of an expensive pulse attenuator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high-voltage wideband pulse load, comprising:

an internal line provided with a rod resistor, and configured such that resistance of the internal line is made to linearly increase along a moving direction of an incoming pulse by the rod resistor;

a dielectric substance coupled to the internal line in a coaxial structure which covers an exterior of the internal line, and configured to have a shape of a non-linearly decreasing external diameter along the moving direction so that impedance linearly decreases along the moving direction in contrast with the resistance of the internal line; and an external housing coupled to the dielectric substance in a coaxial structure which covers an exterior of the dielectric substance, and formed of metal, wherein the dielectric substance comprises slits, which allow a length of surface of the dielectric substance to be extended, around an input terminal.

2. The high-voltage wideband pulse load as set forth in claim 1, wherein the internal line is connected to a ground using a bolt which penetrates through a metal plate connected to the rod resistor.

3. The high-voltage wideband pulse load as set forth in claim 1, wherein the high-voltage wideband pulse load has predetermined characteristic impedance corresponding to total impedance, the total impedance determined by the resistance of the internal line and the impedance of the dielectric substance.

4. The high-voltage wideband pulse load as set forth in claim 3, wherein the dielectric substance has the external diameter which is non-linearly decreases based on an exponential function in which an exponent is determined using the impedance.

5. The high-voltage wideband pulse load as set forth in claim 4, wherein the external diameter of the dielectric substance is proportional to a diameter of the internal line.

6. The high-voltage wideband pulse load as set forth in claim 1, wherein the input terminal is connected to the rod resistor using a connection connector, and is configured to transmit the incoming pulse from an external terminal to the rod resistor through the connection connector.

7. The high-voltage wideband pulse load as set forth in claim 6, wherein the connection connector has an end of diameter which is equal to a diameter of the rod resistor to prevent impedance mismatching.

8. The high-voltage wideband pulse load as set forth in claim 6, wherein the input terminal is coupled to the external terminal using one or more slits.

* * * * *